US006062827A

United States Patent [19]

Shu

[11] Patent Number: 6,062,827

[45] Date of Patent: May 16, 2000

[54] ROTARY PUMP

[76] Inventor: Wu-Shuan Shu, No. 79, Chiao-Cheng Rd., Ta-Li City, Taichung Hsien, Taiwan

[21] Appl. No.: 09/326,664

[22] Filed: Jun. 7, 1999

[51] Int. Cl.[7] ..... F04B 49/00; F04C 17/00

[52] U.S. Cl. ..... 417/310; 417/313; 417/441; 184/6.16; 418/206.4; 418/206.1; 418/47

[58] Field of Search ..... 417/313, 310, 417/441; 184/6.16; 418/206.4, 206.8, 206.7, 206.1, 47

[56] References Cited

U.S. PATENT DOCUMENTS

| | | | |
|---|---|---|---|
| 2,243,874 | 6/1941 | Lysholm | 418/206.4 |
| 3,810,723 | 5/1974 | Johnson | 418/205 |
| 3,988,083 | 10/1976 | Shimizu et al. | 418/264 |
| 4,594,992 | 6/1986 | Nakamura et al. | 123/559.1 |
| 4,595,349 | 6/1986 | Preston et al. | 418/206.1 |
| 4,712,442 | 12/1987 | Baika et al. | 74/467 |
| 4,714,418 | 12/1987 | Matsubara et al. | 418/201.1 |
| 4,770,609 | 9/1988 | Uchida et al. | 417/2 |
| 4,891,820 | 1/1990 | Rando et al. | 372/93 |
| 5,090,879 | 2/1992 | Weinbrecht | 418/9 |

*Primary Examiner*—Charles G. Freay
*Assistant Examiner*—Robert Z. Evora
*Attorney, Agent, or Firm*—Foley & Lardner

[57] ABSTRACT

A rotary pump includes a housing having an inner surface that confines a rotor chamber. Two parallel shafts are mounted pivotally on the housing and extend axially through the rotor chamber. Two meshing multi-lobe rotors are mounted on the shafts within the rotor chamber, respectively. Each of the rotors has a plurality of lobes projecting radially therefrom toward the inner surface without contacting the inner surface.

12 Claims, 6 Drawing Sheets

ROTARY PUMP

BACKGROUND OF THE INVENTION

1. Field of the Invention

This invention relates to a rotary pump adapted for pumping fluids, more particularly to a rotary pump which includes two meshing multi-lobe rotors disposed in a rotor chamber without contacting the latter.

2. Description of the Related Art

FIGS. 1 and 2 illustrate a conventional rotary pump 20. The rotary pump 20 includes a housing 21 having an inner circular surface 212 that confines a rotor chamber 211. A vane-type rotor 22 is disposed eccentrically inside the rotor chamber 211. The rotor 22 is provided with a plurality of elongated grooves 221 which are arranged in a circumferential direction, and a plurality of vanes 222 inserted slidably in the grooves 221. The vanes 222 can be oil-lubricated steel blades or graphite blades. The rotor 22 is connected to an output shaft of a motor 10. A cooling device 11 is mounted on the output shaft of the motor 10. The vanes 222 are slid out of the grooves 221 by centrifugal force, and are pushed back into the grooves 221 by the inner surface 212 during the eccentric rotation of the rotor 22 in the rotor chamber 211.

The steel blades 222 used in the vane-type rotary pump described above, which require lubrication, may become fouled by the lubricant which degrades due to high temperature after being used for a period of time, and will be unable to operate smoothly. Under such circumstances, further operation of the pump 20 can cause severe damage to the blades 222 or even the pump 20 severely damaged.

In addition, when the pump 20 is applied in a printing press, if the lubricant starts to leak out from the pump 20 and splashes onto the paper sheets during printing, the pump 20 will have to be repaired or replaced with a new one.

If graphite blades 222 are used instead of steel blades 222, fine particles of carbon generated by attrition will occur, thereby causing pollution to the environment. Moreover, as the lubricant used in gearing and bearing systems and sealing rings will degrade due to high temperature caused by the friction during eccentric rotation of the rotor 22 in the rotor chamber 211, the degraded lubricant may permeate through the deteriorated sealing rings into the rotor chamber 211 and stick to the graphite blades 222. As such, the service life of the graphite blades 222 can generally be sustained for about one year, and frequent replacement is thus necessary.

Further, the pump 20 requires installation of a cooling device 11 to dissipate the heat generated by the friction described above, and special material for air inlet and outlet pipes. The pump 20 also has disadvantages in that it generates noise and consumes much energy.

SUMMARY OF THE INVENTION

Therefore, it is an object of the present invention to provide a rotary pump that is capable of eliminating the friction described above, thereby dispensing with the cooling device, producing less noise, and consuming less energy.

Accordingly, a rotary pump of the present invention comprises: a housing having an inlet, an outlet and an inner surface that confines a rotor chamber, the inlet and the outlet being spaced apart by and being connected to the rotor chamber; two parallel shafts pivotally mounted on the housing and axially extending through the rotor chamber; two meshing multi-lobe rotors mounted on the shafts within the rotor chamber, respectively, each of the rotors having a plurality of lobes projecting radially therefrom toward the inner surface without contacting the inner surface, the lobes and the inner surface confining a plurality of sub-chambers movable along the inner surface between the inlet and the outlet upon rotation of the rotors; and a drive mechanism mounted on the housing for driving the shafts.

BRIEF DESCRIPTION OF THE DRAWINGS

In drawings which illustrate an embodiment of the invention.

DETAILED DESCRIPTION OF THE PREFERRED EMBODIMENT

Figure 1:
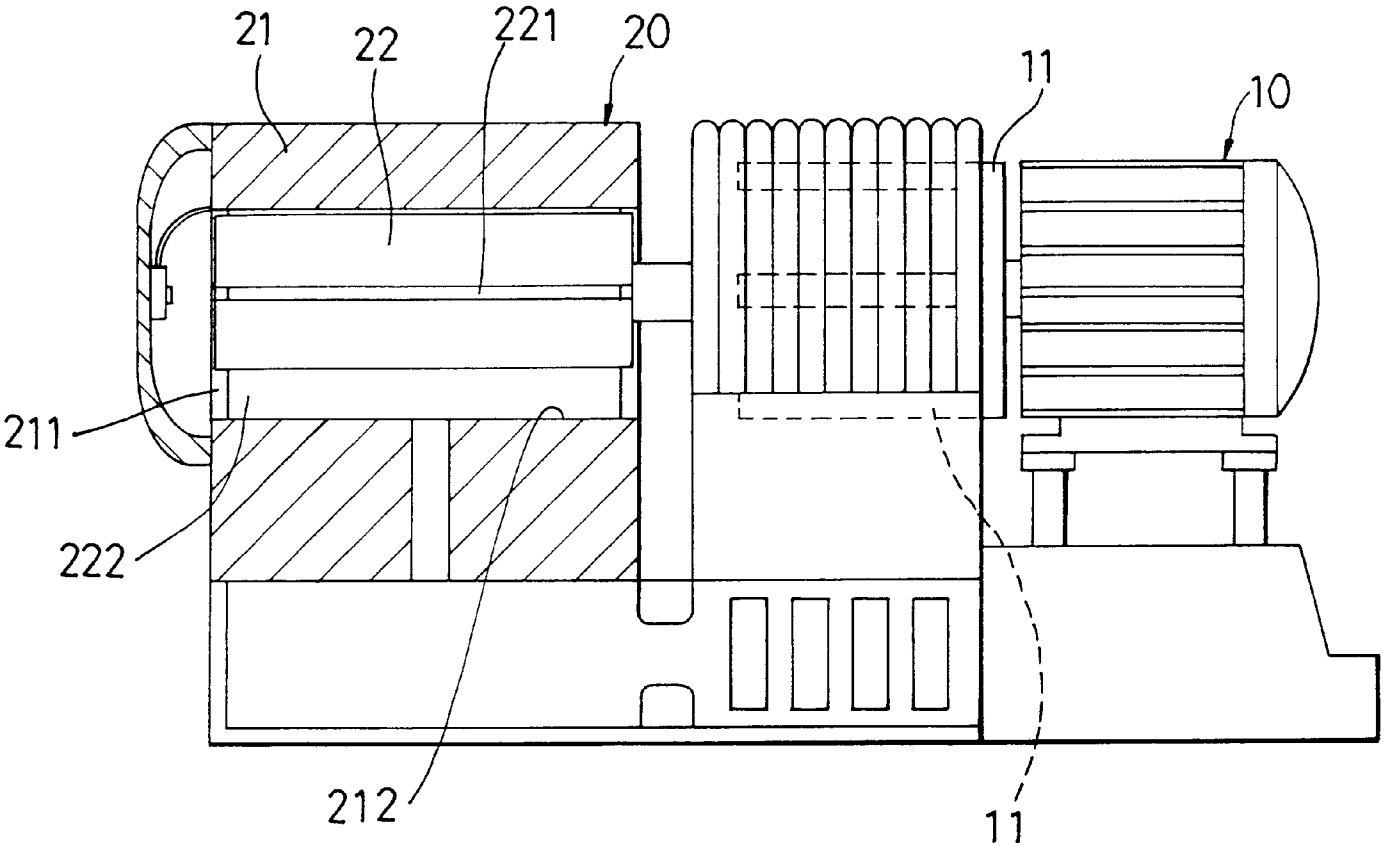
FIG.1 PRIOR ART
FIG. 1 illustrates a conventional vane-type rotary pump.
Figure 2:
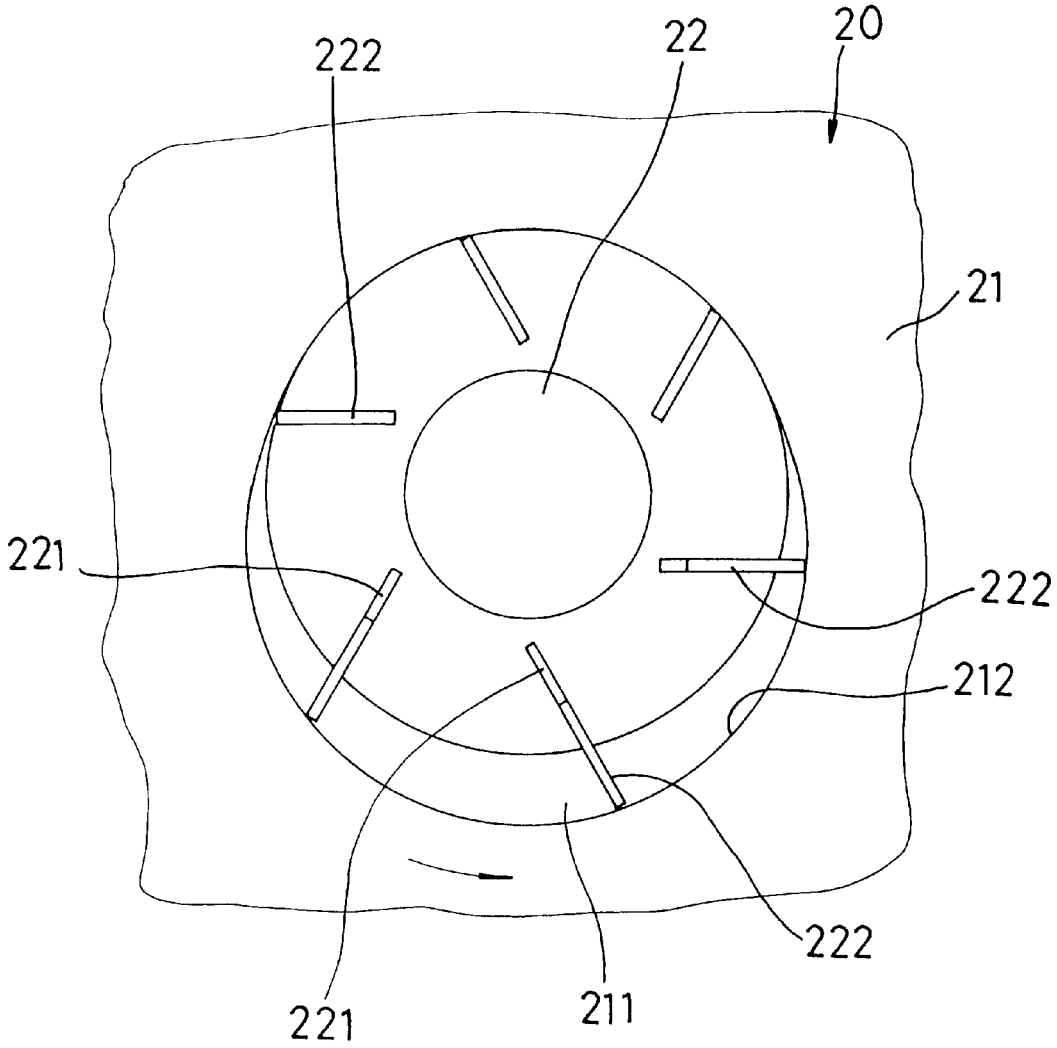
FIG.2 PRIOR ART
FIG. 2 is a fragmentary side view of the pump of FIG. 1.
Figure 3:
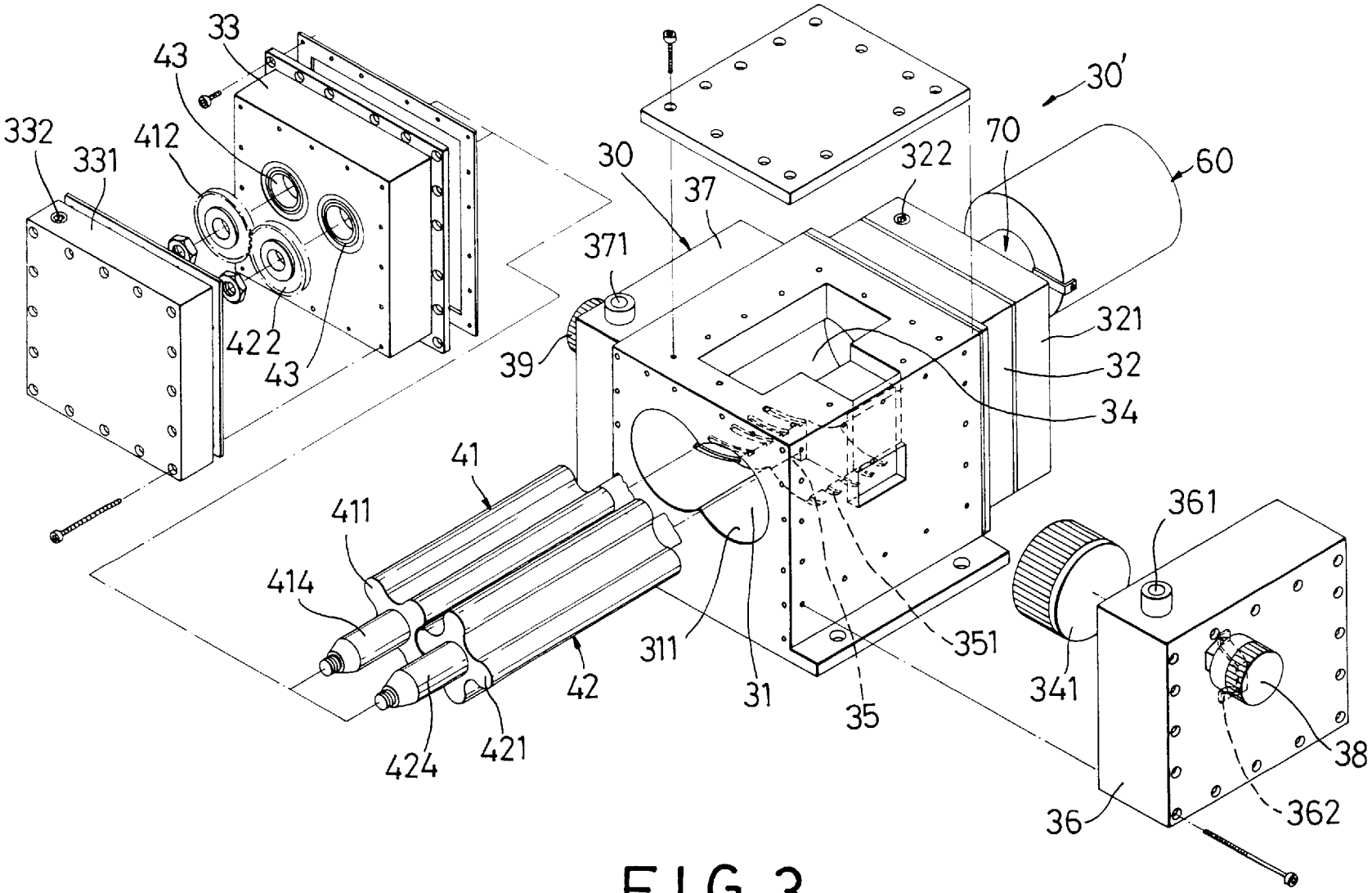
FIG. 3 is an exploded view of a rotary pump embodying this invention.
Figure 4:
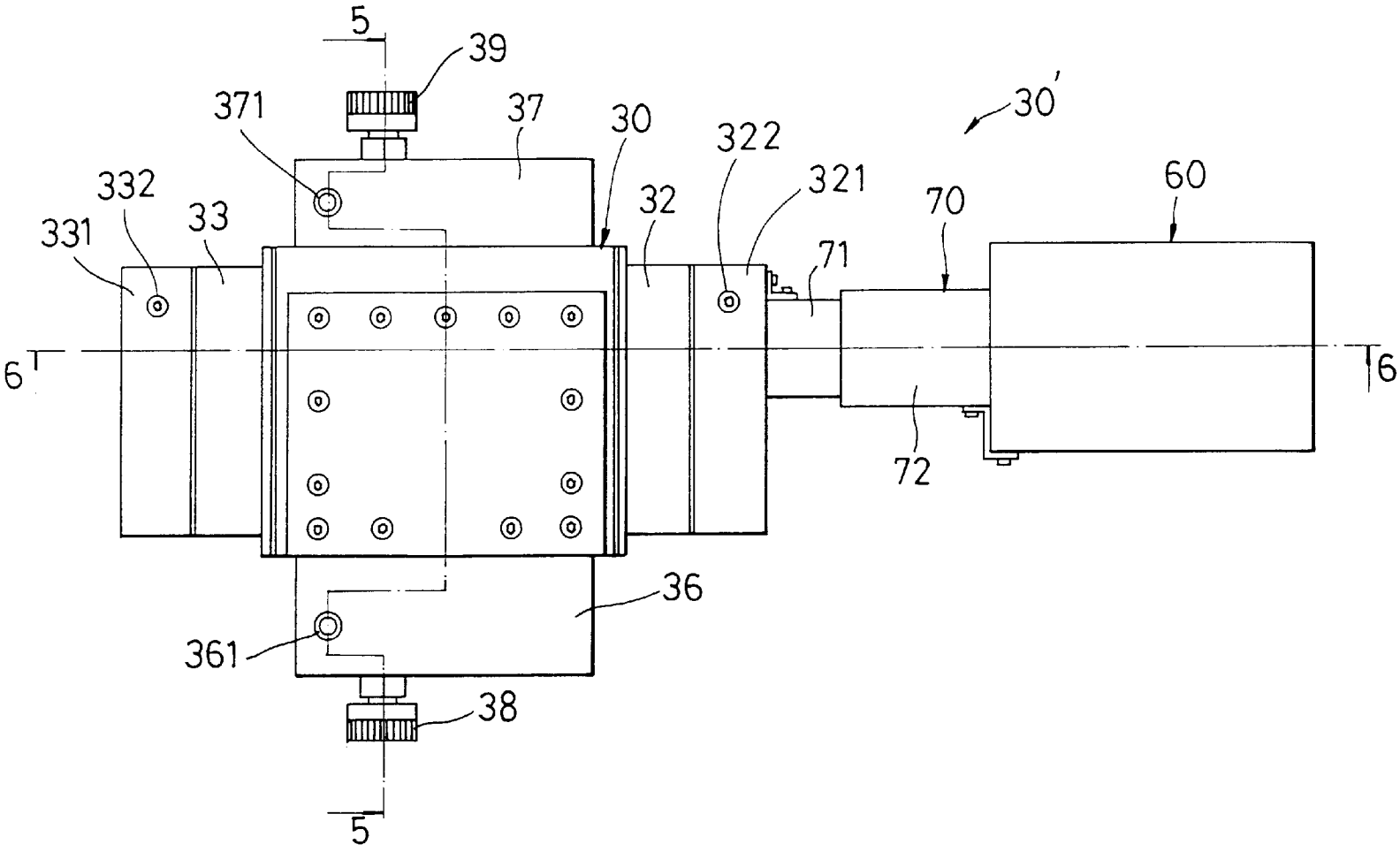
FIG. 4 is a side view of the rotary pump of FIG. 3.
Figure 5:
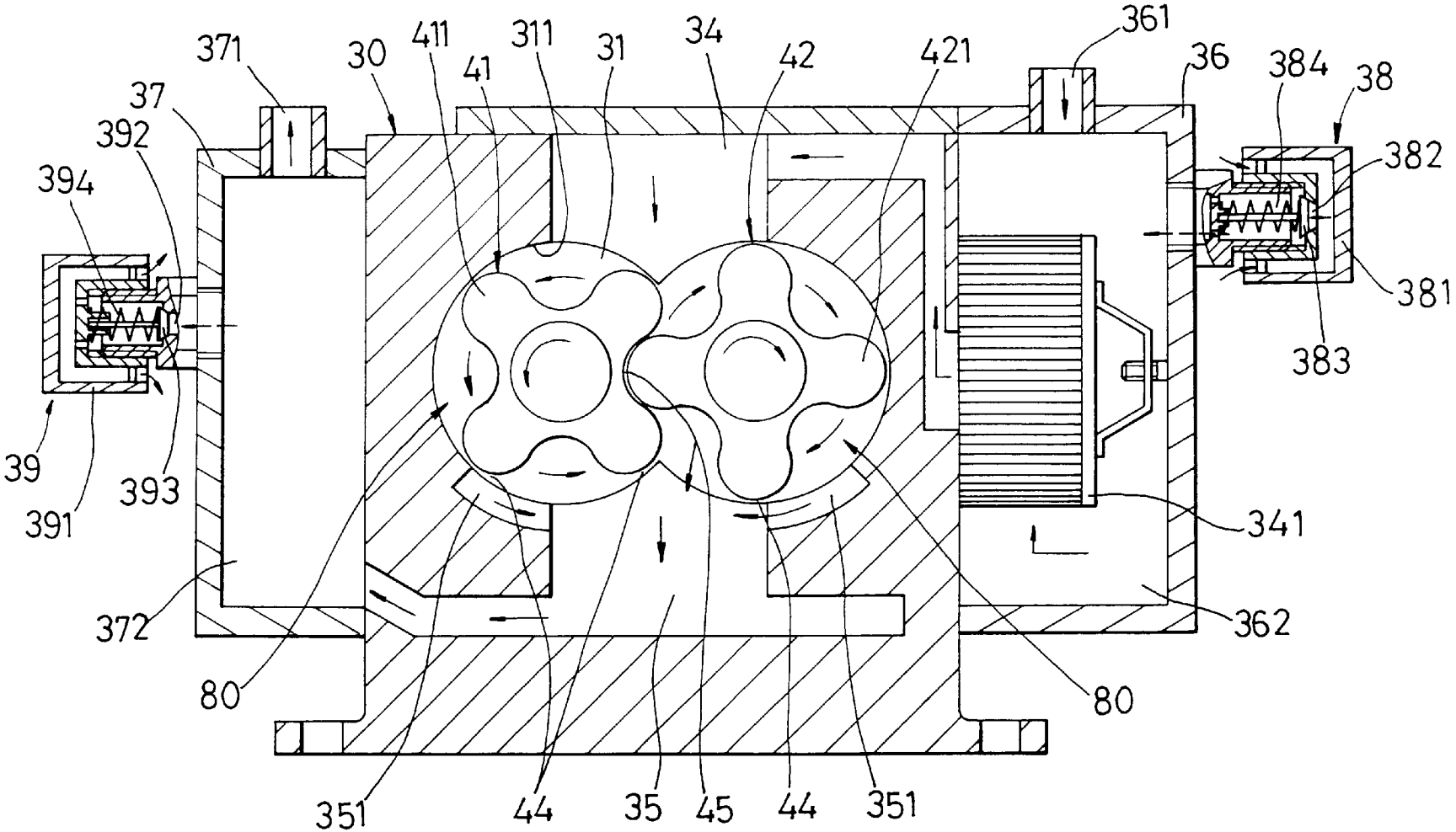
FIG. 5 is a cross-sectional side view of the rotary pump taken along line 5—5 of FIG. 4.
Figure 6:
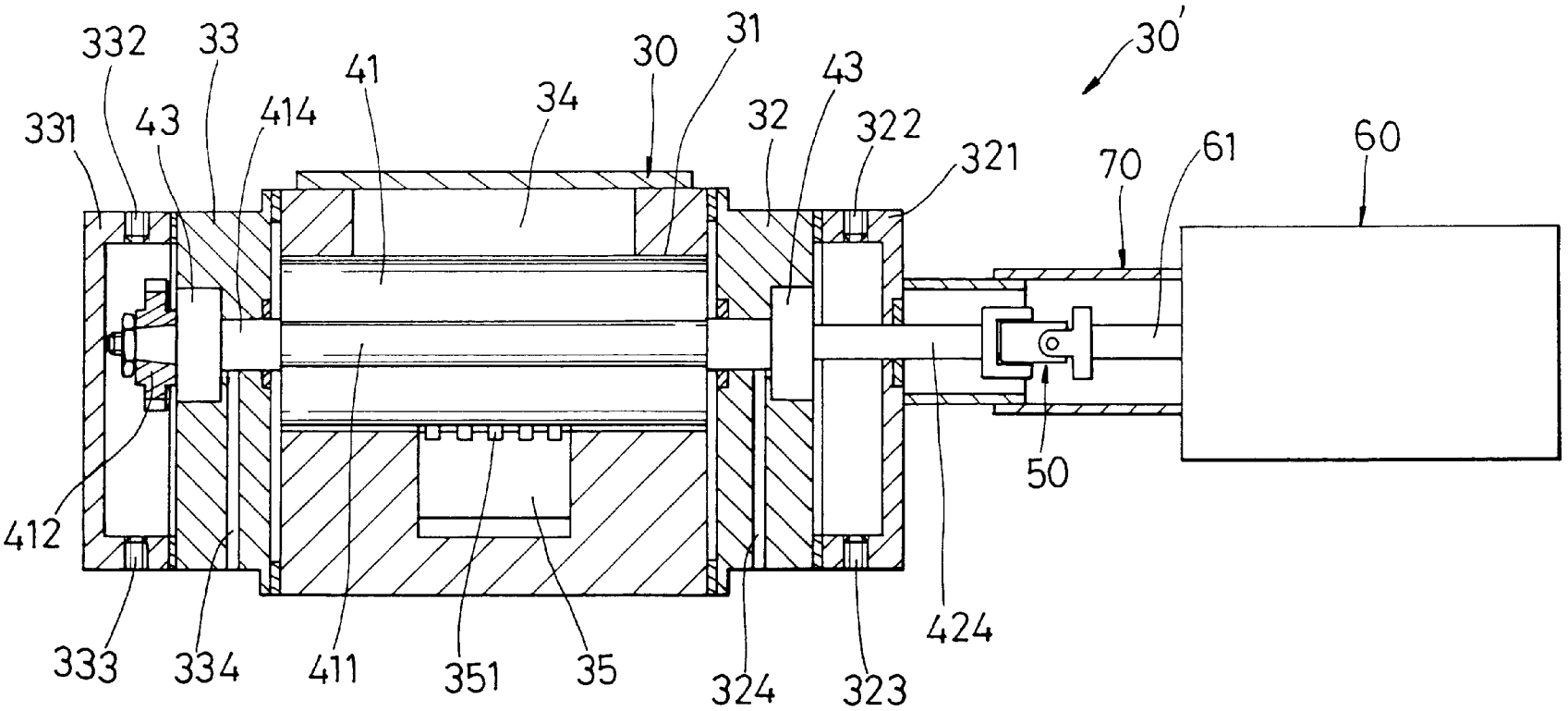
FIG. 6 is a cross-sectional side view of the rotary pump taken along line 6—6 of FIG. 4.

FIGS. 3 to 6 illustrate a rotary pump 30' embodying this invention. The rotary pump 30' includes a housing 30, two four-lobe rotors 41, 42, and a motor 60.

The housing 30 of the rotary pump 30' has an inner surface 311 confining a rotor chamber 31. Two parallel shafts 414, 424 extend axially through the rotor chamber 31. Two opposite front and rear cover bodies 32, 33 are disposed transversely of the shafts 414, 424 and close two opposite ends of the rotor chamber 31, respectively. The front and rear cover bodies 32, 33 are provided with front and rear bearing assemblies 43 thereon, respectively, to rotatably support the shafts 414, 424 inside the front and rear cover bodies 32, 33. Two front and rear lubricant boxes 321, 331 for storing lubricant are disposed outwardly of and are connected to the front and rear cover bodies 32, 33, respectively, to cover the bearing assemblies 43. The front and rear lubricant boxes 321, 331 include lubricant inlets 322, 332 and lubricant outlets 323, 333, respectively.

The housing 30 has an inlet 34 and an outlet 35 disposed on its top and bottom sides. Two left and right cover bodies 36, 37 are disposed on left and right sides of the housing 30, and have a fluid entrance chamber 362 and a fluid exit chamber 372 in communication with the inlet 34 and the outlet 35 of the housing 30, respectively. An air filter 341 is mounted inside the fluid entrance chamber 362, and is connected to the inlet 34 of the housing 30. The left and right cover bodies 36, 37 are provided with regulators 38, 39 for adjusting the pressures inside the fluid entrance chamber 362 and the fluid exit chamber 372. The regulator 38 includes an adjusting knob 381 with an air hole 382, and a valve 383 loaded with a spring 384. The spring 384 presses the valve 383 to seat at the air hole 382, thereby closing the air hole 382. The adjusting knob 381 functions to adjust the urging force of the spring 384 on the valve 383. The regulator 38 only allows fluid to enter into the fluid entrance chamber 362 from the outside. The regulator 39 also includes an air hole 392, a valve 393 connected to a spring 394, and an adjusting knob 391, like the regulator 38, but only allows air to exit from the fluid exit chamber 372.

A plurality of grooves 351 are formed in the inner surface 311 of the housing 30, and are elongated circumferentially toward and are communicated with the outlet 35 of the housing 30. Due to the grooves 351, the amount of air discharged from the outlet 35 is increased.

The four-lobe rotors 41, 42 are mounted on the shafts 414, 424 inside the rotor chamber 31, respectively, and mesh with one another. The lobes 411, 421 of the rotors 41, 42 project radially from the rotors 41, 42 toward the inner surface 311 without contacting and frictioning the inner surface 311. The clearance 44 between each of the lobes 411, 421 and the inner surface 311 is larger than the clearance 45 between the meshing lobes 411, 412. Two meshing gears 412, 422 are mounted on the shafts 414, 424, respectively, inside the front and rear lubricant boxes 321, 331 for producing a synchronized counter-rotation of the meshing rotors 41, 42 in the rotor chamber 31. The motor 60 is disposed at a rear side of the rear lubricant box 321, and has an output shaft 61 provided with a universal joint 50 connected to the shaft 424. A sheath 70 is provided between the lubricant box 321 and the motor 60 to cover the universal joint 50, a rear exposed part of the shaft 424, and the output shaft 61.

The gears 412, 422 and the bearing assemblies 43 are lubricated by the lubricant inside the lubricant boxes 321, 331. The front and rear cover bodies 32, 33 are provided with lubricant discharge channels 324, 334 which extend outwardly of the front and rear cover bodies 32, 33 from the shafts 414, 424, respectively, to prevent the lubricant from entering into the rotor chamber 31.

The lobes 411, 421 of the rotors 41, 42 and the inner surface 311 of the housing 30 confine a plurality of sub-chambers 80 which are movable along the inner surface 311 between the inlet 34 and the outlet 35 of the housing 30 upon rotation of the rotors 41, 42 in the rotor chamber 31 so as to intake air from the fluid entrance chamber 362 and discharge the same to the fluid exit chamber 372.

The rotary pump 30' of the present invention is advantageous in that no friction is produced during the rotation of the rotors 41, 42 in the rotor chamber 31, thereby dispensing with a cooling system and a special material for air pipelines.

When used in a printing press (not shown), an entrance 361 of the fluid entrance chamber 362 and an exit 371 of the fluid exit chamber 372 of the rotary pump 30' are connected to the printing press. The intake air passes through the air filter 341 and the inlet 34 of the housing 30, enters into the rotor chamber 31, and is carried by the sub-chambers 80 to the outlet 35 of the housing 30 via rotation of the rotors 41, 42 in the rotor chamber 31. The flow rate of the air produced by the rotary pump 30' can be controlled by adjusting the pressures in the fluid entrance chamber 362 and the fluid exit chamber 372 via the regulators 38, 39.

The rotary pump 30' of this invention can also be used for aeration in waste water treatment and for wood-working machines.

With the invention thus explained, it is apparent that various modifications and variations can be made without departing from the spirit of the present invention. It is therefore intended that the invention be limited only as recited in the appended claims.

I claim:

1. A rotary pump adapted for pumping fluids, comprising:

a housing having an inlet, an outlet and an inner surface that confines a rotary chamber, said inlet and said outlet being spaced apart by and being connected to said rotary chamber;

two parallel shafts pivotally mounted on said housing and axially extending through said rotary chamber;

two meshing multi-lobe rotors mounted respectively on said shafts within said rotor chamber, each of said rotors having a plurality of lobes projecting radially therefrom toward said inner surface without contacting said inner surface, said lobes and said inner surface confining a plurality of sub-chambers moveable along said inner surface between said inlet and said outlet upon rotation of said rotors;

a drive mechanism mounted on said housing for driving said shafts; and a plurality of grooves which are formed in said inner surface adjacent to said outlet and which are elongated circumferentially toward said outlet and which are communicated with said outlet.

2. The rotary pump of claim 1, wherein the number of said lobes of each of said rotors is four.

3. The rotary pump of claim 1, wherein said housing further includes two opposite front and rear cover bodies disposed transversely of said shafts and closing two opposite ends of said rotor chamber, and front and rear bearing assemblies mounted inside said front and rear cover bodies, respectively, to support said shafts.

4. The rotary pump of claim 3, further comprising front and rear lubricant boxes disposed outwardly of and connected to said front and rear cover bodies, respectively, said shafts extending into said front and rear lubricant boxes, said drive mechanism including gears mounted on said shafts inside said front and rear lubricant boxes.

5. The rotary pump of claim 4, wherein said front and rear cover bodies further include lubricant discharge channels extending outwardly of said front and rear cover bodies from said shafts.

6. The rotary pump of claim 4, wherein said drive mechanism further comprises a motor disposed at a rear side of said rear lubricant box and having an output shaft provided with a universal joint, one of said shafts extending outwardly of said rear lubricant box and being connected to said universal joint.

7. The rotary pump of claim 6, further comprising left and right cover bodies connected to two opposite sides of said housing and substantially parallel to said shafts, said left and right cover bodies having a fluid entrance chamber and a fluid exit chamber in communication with said inlet and said outlet, respectively.

8. The rotary pump of claim 7, further comprising an air filter mounted inside said fluid entrance chamber and connected to said inlet.

9. The rotary pump of claim 7, further comprising a pressure regulator connected to each of said fluid entrance and fluid exit chambers to control pressure thereof.

10. The rotary pump of claim 1, wherein said housing further has left and right sides on two sides of said rotor chamber, and a fluid entrance chamber and a fluid exit chamber respectively disposed at said left and right sides in communication with said inlet and said outlet.

11. The rotary pump of claim 10, further comprising an air filter mounted inside said fluid entrance chamber and connected to said inlet.

12. The rotary pump of claim 10, further comprising a pressure regulator connected to each of said fluid entrance and fluid exit chambers to control pressure thereof.

* * * * *